United States Patent [19]

Ibrahim

[11] 4,302,946

[45] Dec. 1, 1981

[54] REFRIGERATION SYSTEM USING AIR DEFROST

[75] Inventor: Fayez F. Ibrahim, Niles, Mich.

[73] Assignee: Tyler Refrigeration Corporation, Niles, Mich.

[21] Appl. No.: 8,927

[22] Filed: Feb. 2, 1979

[51] Int. Cl.[3] ..... F25D 21/12

[52] U.S. Cl. ..... 62/82; 62/256; 62/282; 62/234

[58] Field of Search ..... 62/82, 256, 282, 234, 62/155

[56] References Cited

U.S. PATENT DOCUMENTS

| | | | |
|---|---|---|---|
| 3,403,525 | 10/1968 | Beckwith et al. | 62/82 |
| 3,444,698 | 5/1969 | Lorenz | 62/256 |
| 3,850,003 | 11/1974 | Beckwith et al. | 62/82 |
| 4,026,121 | 5/1977 | Aokage et al. | 62/256 |

*Primary Examiner*—Albert J. Makay
*Assistant Examiner*—Henry Bennett
*Attorney, Agent, or Firm*—LeBlanc, Nolan, Shur & Nies

[57] ABSTRACT

A refrigeration system employing ambient air defrost and a method of operating such a system. The refrigeration system includes a cabinet having an opening in one of its walls, for enabling access to products in the interior of the cabinet. Extending along the walls of the cabinet are an inner, primary air conduit and an outer, secondary air conduit. The primary air conduit contains a plurality of fans for circulating the air along the conduit and a mechanism for refrigerating air passing through the conduit during a refrigeration cycle. The air circulated through the primary conduit forms a closed primary air band. A plurality of second fans are arranged within the secondary air conduit and during a refrigeration cycle circulate air through the conduit, thereby establishing a closed secondary air band during the refrigeration cycle. When the system is to be defrosted, the refrigeration mechanism is deactivated so that the air passing along the primary air conduit is not refrigerated. In addition, the secondary fans in the secondary air conduit are turned off and the primary fans in the primary conduit are operated so as to cause a greater quantity of air to pass along the primary air conduit. During the defrost mode of operation, the primary air fans tend to draw in ambient air from outside of the cabinet thereby providing warmer air for circulation through the primary air conduit which serves to defrost the refrigeration mechanism.

34 Claims, 3 Drawing Figures

REFRIGERATION SYSTEM USING AIR DEFROST

BACKGROUND OF THE INVENTION

The present invention relates to refrigerated display cases employing ambient air defrost and a method of operating such cases. Both within the specification and the claims of the present application, all references to refrigeration apparatus or refrigeration operations are intended to include both cooling at a temperature below 32° F., such as associated with frozen food display cases, and in excess of 32° F., such as typically associated with diary food and fresh meat display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters that are arranged adjacent to the refrigeration coils of the refrigeration mechanism. During a defrost cycle, these heaters supply heat in an effort to eliminate the frost buildup on the coils; however, the heaters also add warmer air to the air conduit for circulation within the case. During such a defrost cycle, the fans for circulating air through the primary air conduit, i.e. the conduit in which the coils are located, can be turned off as disclosed in U.S. Pat. No. 3,756,038 to MacMaster et al. The particular technique is relatively simple both in its construction and operation. However, the electrical heaters are high wattage heaters that utilize significant electricity during operation. Furthermore, the warm air circulated in the case can raise the temperature of the case too high. Thus, attempts have been made to find alternatives to such a system.

A second type of system circulates compressed gaseous refrigerant through the refrigeration coils during the defrost cycle. During the defrost cycle, a valve control mechanism shuts off the supply of refrigerant to the refrigeration coils and alternatively feeds compressed gaseous refrigerant through the coils. This gas serves to reduce any frost buildup that has occurred on the refrigeration coils but simultaneously provides heat within the air conduit which can be circulated through the display case, which again is disadvantageous. Due to the requirement that the system be able to selectively switch between the supply of the gas for defrosting and refrigerant to the refrigeration coils, a valving structure must be provided. Such a mechanism increases the cost of construction of the system. In addition, the provision of such a system increases the number of parts capable of breaking down thereby necessitating costly repairs.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,403,525, 3,850,003 and 3,937,033, all to Beckwith et al. These systems use fans separate and distinct from the main air circulating fans. These extra fans are only turned on during the defrost cycle for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith et al. U.S. Pat. No. 3,850,003 indicates that the concepts described in U.S. Pat. Nos. 3,082,612 and 3,403,525 did not prove to be practical and hence were not commercially feasible.

Finally, a third type of ambient air defrosting system is shown in U.S. Pat. No. 4,144,720 to Subera et al., which is assigned to the same assignee as the present application. In the foregoing patent application, an open front refrigerated display case having primary and secondary air conduits is disclosed. In this system, the direction of airflow within one of the conduits is reversed, for example by the use of reversible fans, thereby drawing in air from outside of the display case. Two other patents disclosing the use of reversible fans for ambient air defrost are U.S. Pat. No. 4,026,121 to Aokage and U.S. Pat. No. 4,120,174 to Johnston.

SUMMARY OF THE INVENTION

An object of the present invention is to provide an ambient air defrost system within an refrigerated display case having an opening in one of its walls, which defrost system is both relatively simple to construct and easily operated as compared to previously known systems.

Another object of the present invention is to provide a refrigerated display case employing an ambient air defrost system in which standard unidirectional fans can be employed without having to rely upon additional baffles or other mechanisms for changing the flow directions in the air conduits.

A further object of the present invention is to provide an open front refrigerated display case in which during a defrost mode of operation, the quantity of air passing through the primary air conduit is increased and such air is not refrigerated and the secondary band of air is turned off so as to enable ambient air from outside of the display case to enter the primary air conduit.

Still another object of the present invention is to provide an open front refrigerated display case having mechanisms for establishing during a refrigeration mode of operation a primary refrigerated air band circulating around the case adjacent to the interior of the case, a secondary unrefrigerated air band circulating around the case on the outside of the primary air band and a tertiary ambient air curtain passing along the front of the case adjacent to the opening in the case without entering the case during the refrigeration mode; during the defrost mode of operation the quantity of air passing along the primary air band is increased, however such air is not refrigerated, the secondary air band is turned off and the air passing along the tertiary, ambient air curtain is drawn into the primary air band.

A still further object of the present invention is to provide an improved procedure for defrosting a refrigerated display case by the use of ambient air without requiring the employment of reversible air fans or movable baffles.

These objectives are achieved by the construction of a refrigerated display case, which has an opening in one of its walls for enabling access to the interior of the case, in accordance with the present invention. The case is provided with an approximately U-shaped primary air conduit that extends around the case and has outlet and inlet openings directed in alignment across the opening in the case. A secondary air conduit surrounds the primary air conduit and also extends along the case and has outlet and inlet openings directed in alignment across the opening in the case. During the refrigeration mode of operation of the case, a fan, or normally a plurality of fans, positioned within the primary air conduit circulates air along the conduit so that the air passes through a set of evaporation coils arranged within the conduit for refrigerating such air. Also during the refrigeration mode of operation, air is circulated along the secondary air conduit by a fan, or a plurality of fans, arranged within the secondary air conduit. The air passing through the secondary air conduit, while unrefrigerated, is still cooler than ambient air and serves to form a blocking curtain for preventing ambient air from entering the interior of the case and the primary air conduit. During the defrost mode of operation, the fans within the secondary air conduit are deactivated thereby turning off the blocking curtain formed by the secondary air band. Simultaneously, the quantity of air passing along the primary air curtain is increased and the evaporation coils are turned off so that such air is not refrigerated. Due to the increased quantity of air passing along the primary air band and the deactivation of the secondary air band, ambient air from outside of the display case is drawn into the primary air conduit thereby increasing the temperature of the primary air band. This warmer air serves to defrost the evaporation coils and other mechanisms located within the primary air conduit. In the preferred embodiment of the present invention, there also is provided a mechanism for establishing a tertiary air curtain of ambient air that passes along the opening in the refrigerated display case outside of the secondary air curtain. This curtain of ambient air does not enter the interior of the case or the primary or secondary air conduits during the refrigeration mode of operation. During the defrost mode of operation, however, when the secondary air band and likewise the secondary, blocking air curtain are turned off, the increased flow of air through the primary air conduit serves to draw ambient air from the tertiary air curtain into the primary air conduit. To assist this operation, during the defrost mode, the quantity of air propelled along the tertiary air curtain can be increased. While the quantity of airflow is changed during the refrigeration and defrost cycles, the direction of airflow through the conduits is not changed.

The increased flow of air through the primary air conduit and the increased quantity of air propelled along the tertiary air curtain which provides additional ambient air for passing through the primary air conduit serve to increase the speed at which the frost buildup within the system, in particular on the refrigeration coils, can be eliminated. The defrosting operation should be carried out as quickly as possible in order to avoid any significant increase of the temperature within the display case. This increased flow of air through the primary air conduit and along the tertiary air curtain can be accomplished by either increasing the speed of the respective fans or by providing additional fans within the primary air conduit and the air conduit associated with the tertiary air curtain, which fans are turned on during the defrost mode for increasing the quantity air being propelled through the respective conduits.

In accordance with the preferred embodiment of the present invention, the defrost system of the invention is employed in the construction of an open front refrigerated display case. By constructing an open front refrigerated display case in accordance with the present invention as described and claimed herein, the cost of manufacturing, maintaining and operating a display case can be minimized. The display case according to the present invention has less moving parts than many of the other prior art systems, such as those shown by the patents to Beckwith et al. listed above, which require the use of additional fans and/or additional moving parts. The display case also is significantly less complex than the gas defrost system and hence far less expensive to construct. Furthermore, the display case avoids the operating costs incurred in employing electric heaters for defrosting.

DESCRIPTION OF THE PREFERRED EMBODIMENTS

Figure 1:
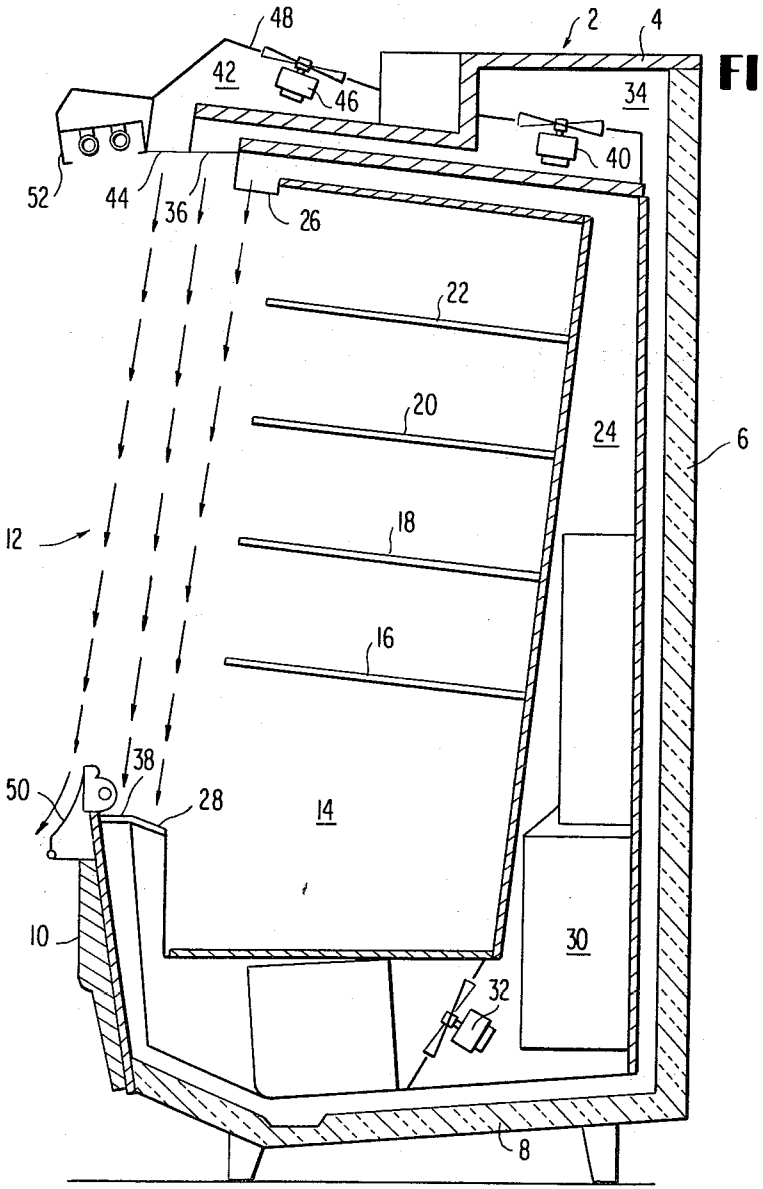
FIG. 1 is a side elevational, sectional view of an open front refrigerated display case constructed in accordance with the present invention and operated in a refrigeration mode of operation.

A refrigerated display case having an ambient air defrost system in accordance with the present invention is illustrated in FIG. 1. Cabinet 2 of the display case has a top wall 4, a rear wall 6, a bottom wall 8 and a front wall, formed partially by a kick panel 10. Cabinet 2 also has two side-walls which are not illustrated in the drawings. Within the interior 14 of cabinet 2, there are arranged a plurality of storage shelves 16, 18, 20 and 22. The food to be refrigerated, which can be frozen food, is set out on the storage shelves. An opening 12 in the front wall of cabinet 2 enables the consumers to obtain access to the food on the storage shelves.

Extending around the cabinet along the front, bottom, rear and top walls of the cabinet is a first air conduit 24 in which the primary air band is established. Conduit 24 has an outlet opening 26 and an inlet opening 28. Openings 26 and 28 are arranged in alignment at opposing ends of opening 12 in cabinet 2 so that air leaving outlet opening 26 of conduit 24 is directed to and received by inlet opening 28 of conduit 24. Thus, when air is circulated through air conduit 24, a continuous band of air can be established.

Arranged within conduit 24 are a refrigeration coil unit 30, which contains a plurality of evaporation coils, and a plurality of primary fans, represented by fan 32. During the refrigeration mode of operation, refrigeration coil unit 30 is activated and fans 32 circulate air through the primary air conduit 24 so that the air passes through the refrigeration coils and is refrigerated. In this manner, a primary band of refrigerated air is established in cabinet 2.

A second air conduit 34 extends around the cabinet outside of primary air conduit 24. Air conduit 34 has an outlet opening 36 and an inlet opening 38. Openings 36 and 38 are arranged in alignment at opposing ends of opening 12 in cabinet 2. Thus, as air is circulated through conduit 34, a continuous secondary air band is established. While the air within the secondary air band is not refrigerated, the air is cooled to some extent by conduction. The arrangement of the secondary air band adjacent to the refrigerated primary air band and the presence of a common wall between the two conduits enable the air within the secondary air band to be cooled by conduction of the cooler temperatures through the common wall. Inasmuch as the secondary air band is continuously circulated during the refrigeration mode of operation, without the introduction of ambient air into the second conduit, the air of the secondary air band is maintained at a temperature colder than ambient air.

Positioned within secondary air conduit 34 are a plurality of fans for circulating the air, which fans are represented by fan 40. Fans 40 are capable of either circulating air through the secondary air conduit or being turned off so that no air is circulated through the secondary air conduit.

Finally, in accordance with the preferred embodiments of the present invention, a third, ambient air conduit 42 is provided for directing ambient air along the front of the display case. Conduit 42 has an outlet opening 44 which directs air along opening 12 in cabinet 2. During the refrigeration mode of operation, this ambient air passes along the front of the cabinet and is substantially deflected away from the cabinet when it reaches deflector 50 arranged at the top of kick panel 10. Ambient air is drawn into conduit 42 by a plurality of fans such as fan 46, which are arranged within a portion 48 of top wall 4 of cabinet 2.

During the refrigeration mode of operation, air is circulated through all three of the air conduits, i.e. conduit 24, conduit 34 and conduit 42. Air is circulated through conduit 24 by fans 32 and is refrigerated by refrigeration unit 30. This refrigerated air leaves conduit 24 through outlet opening 26 and reenters the conduit through inlet opening 28, such as shown by the arrows across opening 12 in cabinet 2 illustrated in FIG. 1. Also, during the refrigeration mode of operation, air is circulated through conduit 34 by fans 40. Air leaves conduit 34 through an outlet opening 36 and reenters the conduit through inlet opening 38. In this manner, a continuous air band is established within the cabinet that includes a secondary, blocking air curtain across opening 12 in cabinet 2 such as shown in the arrows in FIG. 1.

Finally, the ambient air drawn into conduit 42 by fans 46 is expelled through outlet 44 in a direction along the front of the cabinet such as shown by the arrows. This ambient air is expelled in a direction so that it is not drawn into the primary or secondary air conduits during the refrigeration mode of operation. In addition, the ambient air is deflected away from the cabinet by deflector 50 located above kick panel 10. Thus, during the refrigeration mode of operation, the secondary and tertiary air band serve to prevent ambient air from entering either the interior of the cabinet or from being mixed with the air circulating in the primary air band.

Figure 2:
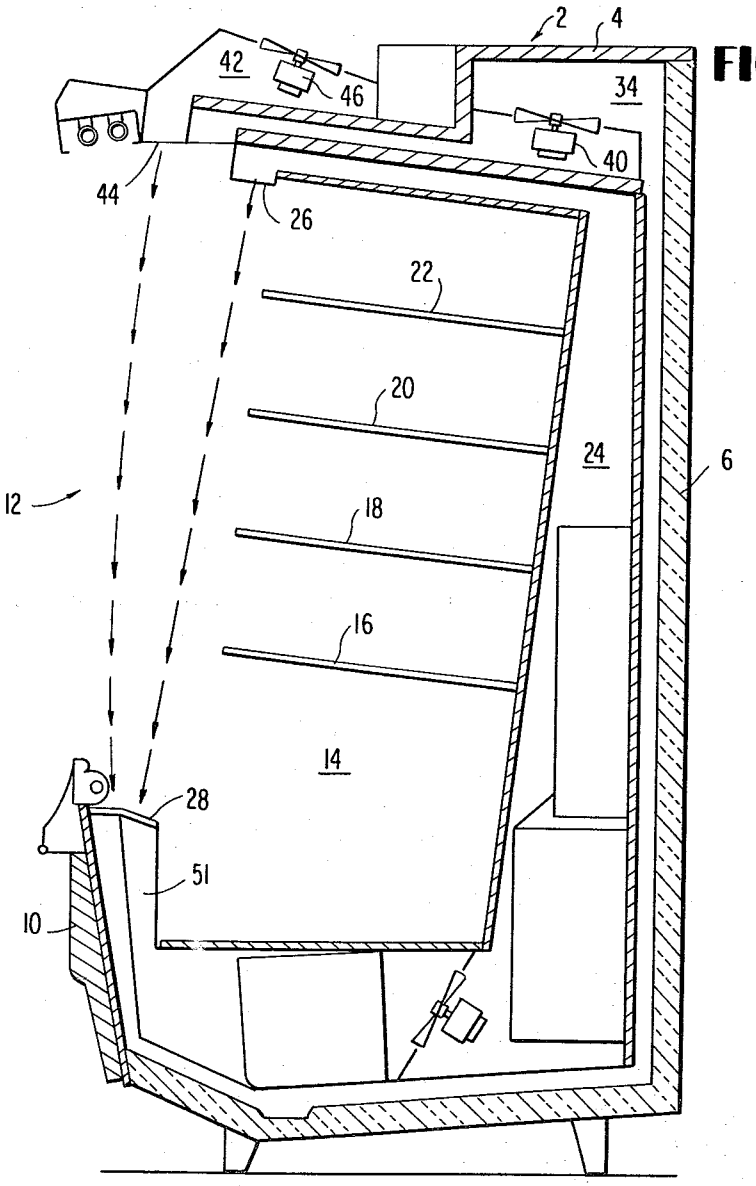
FIG. 2 is a view identical to FIG. 1 of an open front refrigerated display case in accordance with the present invention, except that the case is being operated in a defrost mode of operation.

Turning to FIG. 2, a description of the refrigerated display case during the defrost mode of operation will now be provided. During the defrost mode of operation, the fans 40 are turned off so that air is not circulated through secondary air conduit 34. Thus, the blocking action of the secondary air curtain is eliminated. Next, the quantity of air passing through conduit 24 is increased either by increasing the speed of fans 32 or by actuation of additional fans such as fan 32 arranged within conduit 24. At the same time that the quantity of air passing through conduit 24 is increased, refrigeration unit 30 is deactivated so that such air is not refrigerated during the defrost mode of operation.

Finally, the air passing along the tertiary air curtain can be increased by either increasing the speed of fans 46 or by actuating additional fans such as fans 46. When the quantity of air flow through air conduit 24 is increased, there is a tendency for a partial vacuum to be created in plenum 51 adjacent to inlet opening 28. This partial vacuum creates a suction action for drawing in a greater quantity of air from the area surrounding opening 28. Inasmuch as the secondary air curtain has been removed, this suction action causes the tertiary ambient air curtain to be directed towards inlet 28 and to enter conduit 24. This action serves to increase the temperature of the air passing through conduit 24 during the defrost mode of operation. In this manner, the coils in refrigeration unit 30 and other mechanisms arranged within conduit 24 can be defrosted by the warmer air.

Lighting unit 52 containing a plurality of fluorescent lights can be provided at the top front of cabinet 2 for providing light so that the products within interior 14 of cabinet 2 are more readily visible to the consumer. The lights also provide some heat which is absorbed by the air passing along the tertiary, ambient air curtain. When the air from the tertiary air curtain is used for increasing the temperature of the air within the primary air band, the lights in effect contribute to that purpose.

Figure 3:
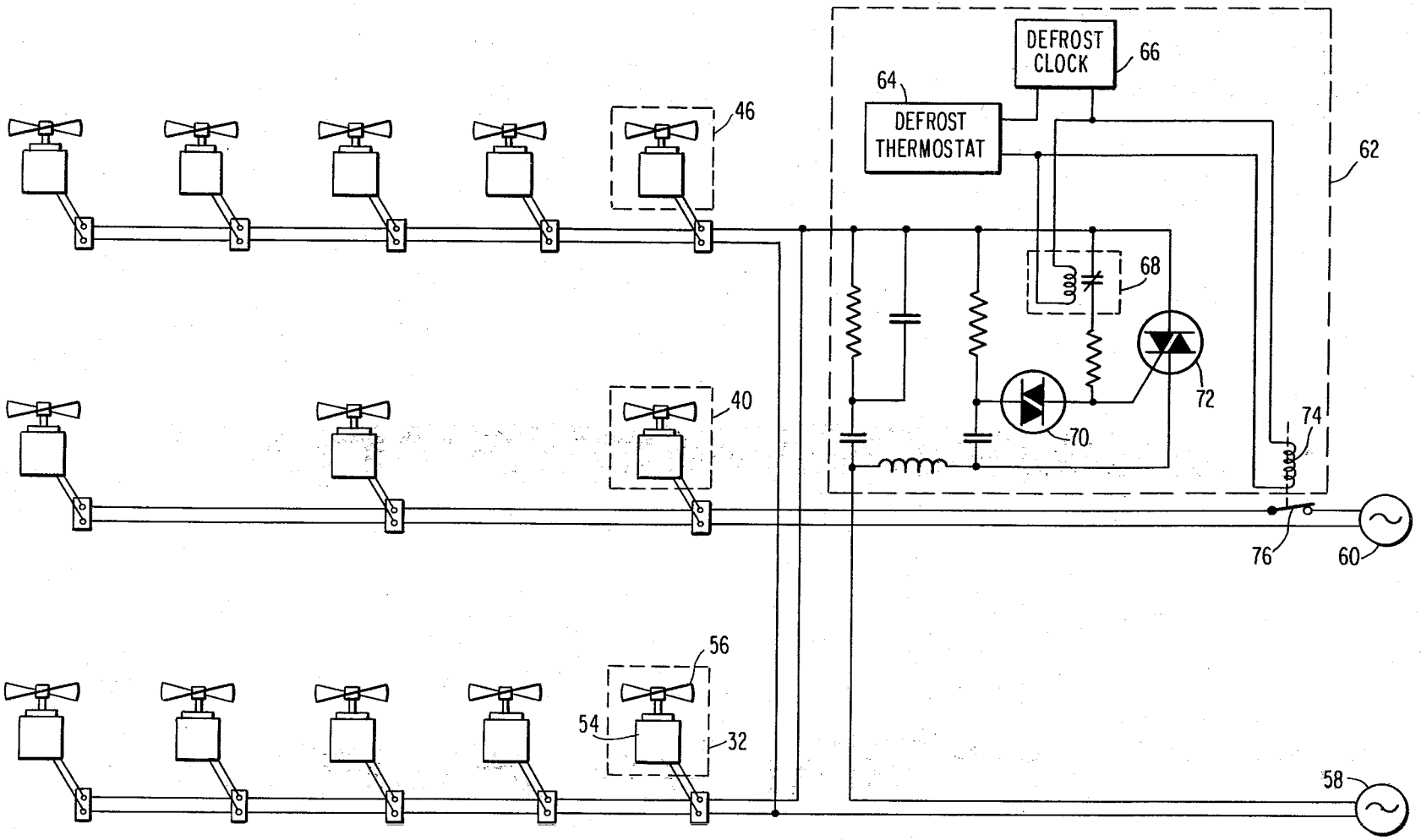
FIG. 3 is a schematic diagram of the control system for the refrigerated display case in accordance with the present invention.

Turning now to FIG. 3, the operation of the system during the refrigeration and defrost modes will be explained in greater detail. This figure provides a schematic illustration of the control unit for operating the fans in the primary, secondary and tertiary air conduits during both modes of operation.

Each of the fan units, such as unit 32, includes a motor 54 and a blade 56. The fans are all provided with a 115-volt, 60-cycle AC signal during the refrigeration mode of operation. These signals are provided through signal sources 58 and 60.

During a defrost mode of operation, control unit 62 serves to vary the voltage signal applied to the fans in each of the respective air conduits. Control unit 62 is actuated so as to vary the signals in response to a signal received from either a defrost thermostat 64 or a defrost clock 66. The thermostat will cause unit 62 to switch into a defrost mode of operation when the temperature within the cabinet has dropped to a predetermined level. Alternatively, defrost clock 66 can provide periodic signals for actuating the switch from the refrigeration mode to the defrost mode of operation. In addition, defrost clock 66 can control the duration of the defrost mode of operation.

The signals generated by thermostat 64 and clock 66 are provided to relays 68 and 74. Relay 74 controls switch 76 arranged within the supply line to fans 40 in secondary air conduit 34. Switch 76 is normally in a closed position and upon supply of a signal to relay 74, switch 76 is moved into an open position. The opening of switch 76 disconnects signal source 60 from fans 40 thereby causing the fans to be deactivated so that air is not circulated along the secondary air conduit.

The signals supplied to relay 68 control the operation of a solid stage voltage control mechanism which includes diac 70 and triac 72 along with a plurality of resistors, capacitors and inductors, such as illustrated in FIG. 3. This solid state voltage control unit will vary the voltage being supplied to the motors of fans 32 and 46 during the defrost mode of operation. The motors of the fans, such as motor 54, are of such a nature that when an increased voltage is supplied, the fans will operate at a higher speed thereby propelling a greater quantity of air through the respective air conduits. As previously mentioned, in an alternative embodiment of the present invention, instead of increasing the speed of the fans, additional fans within the primary and tertiary air conduits can be activated so as to increase the quantity of air flowing through those conduits.

After a set period of time, or after the temperature within the primary air conduit has returned to a predetermined level, control unit 62 operates to return the system to the refrigeration mode of operation. In this situation, relay 74 is deactivated thereby enabling switch 76 to close and fans 40 to be reactivated so as to reestablish the secondary air band. Furthermore, the voltage control effect of unit 62 changes the voltage supplied to the fans in the primary and tertiary air conduits so that those fans are again operated at their normal speed for the refrigeration mode of operation which is lower than their speed during the defrost mode of operation.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A method for selectively refrigerating and defrosting a refrigeration system including a cabinet having: top, bottom and side walls and an opening in one of the walls for enabling access to products displayed within the cabinet; a first air conduit extending around the cabinet and having an air outlet and an air inlet at respective opposing ends of the opening in the cabinet; a refrigeration mechanism arranged within the first air conduit; and a second air conduit extending around the cabinet and positioned toward the outside of the cabinet with respect to the first air conduit and having an air outlet and an air inlet at the respective opposing ends of the opening in the cabinet; the method comprising the steps of:

establishing a primary air band in the first air conduit by circulating air through the first air conduit and directing air leaving the air outlet of the first air conduit towards the air inlet of the first air conduit and refrigerating such air during a refrigeration cycle by the refrigerating mechanism;

establishing a secondary air band in the second air conduit during a refrigeration cycle by circulating air through the second air conduit and directing air leaving the air outlet of the second air conduit towards the air inlet of the second air conduit;

temporarily terminating the active circulation of air through the second air conduit during a defrost cycle; and increasing the quantity of air flowing through the first air conduit during the defrost cycle and simultaneously turning off the refrigerating mechanism whereby ambient air is drawn into the first air conduit and such air acts to defrost any frost buildup within the first air conduit during the defrost cycle.

2. A method according to claim 1 further comprising the step of establishing an ambient air curtain along a path outside of and substantially parallel to the second air band passing across the opening in the cabinet.

3. A method according to claim 2 wherein the step of establishing an ambient air curtain includes drawing ambient air from outside of the cabinet into a third air conduit and propelling such ambient air through the third air conduit and expelling such ambient air from the third air conduit in a direction along a path for forming the ambient air curtain.

4. A method according to claim 2 or 3 wherein a greater quantity of air is propelled along the ambient air curtain during the defrost cycle than during the refrigeration cycle.

5. A refrigeration system capable of being selectively operated in a refrigeration cycle and a defrost cycle, said system comprising:

a cabinet having top, bottom and side walls and an opening in one of said walls for enabling access to products displayed within said cabinet;

means for establishing a primary band of refrigerated air within said cabinet, said means including: a first air conduit extending around said cabinet and having an air outlet and air inlet at respective opposing ends of said opening in said cabinet; first air circulating means for circulating air through said first air conduit, said first air circulating means being selectively operable in first and second modes of operation, where during said second mode of operation a greater quantity of air is circulated within said first air conduit for a given period of time than during said first mode of operation; refrigeration means for cooling air being circulated through said first air conduit during a refrigeration cycle; and means for directing air leaving said outlet of said first air conduit towards said inlet of said first air conduit;

means for establishing a secondary air band passing along a path outside of said primary air band, said means including: a second air conduit extending around said cabinet and positioned towards the outside of said cabinet with respect to said first air conduit and having an air outlet and an air inlet at respective opposing ends of said opening in said cabinet; second air circulating means for circulating air through said second air conduit for creating said secondary air band, said second air circulating means being selectively switchable between an on and off condition; and means for directing air leaving said air outlet of said second air conduit towards said air inlet of said second air conduit; and control means for controlling the operation of said first and second air circulating means and said refrigeration means, during a refrigeration cycle said control means causes said refrigeration means to be operated for cooling the air moving through said first air conduit, said first air circulating means to be operated in its first mode of operation and said second air circulating means to be in its on condition and during a defrost cycle said control means switching said first air circulating means into its second mode of operation for increasing the quantity of air flowing through said first air conduit and turning off said refrigeration means and said second air circulating means so that ambient air is drawn into said first air conduit and such ambient air acts to defrost any frost build-up in said first air conduit.

6. A system according to claim 5 further comprising means for establishing an ambient air curtain along a path outside of and substantially parallel to the portion of said second air band passing across said opening in said cabinet.

7. A system according to claim 6 wherein said first air circulating means includes a first fan and said second air circulating means includes a second fan.

8. A system according to claim 6 or 7 wherein said means for establishing said ambient curtain includes a third air conduit disposed outwardly of said second air conduit and a third fan positioned within said third air conduit for drawing ambient air into said third conduit and propelling such ambient air through said third conduit towards an outlet in said third conduit that directs such ambient air in a direction along a path for forming said ambient air curtain.

9. A system according to claim 5 or 6 wherein said refrigeration means includes a set of evaporation coils and said set of evaporation coils are arranged within said first air conduit.

10. A system according to claim 6 wherein said first air circulating means includes a first plurality of fans and said second air circulating means includes a second plurality of fans.

11. A system according to claim 7 wherein said first fan is capable of being selectively operated at a first speed during the refrigeration cycle and at a second higher speed during the defrost cycle.

12. A system according to claim 6, 7 or 10 wherein said means for establishing said ambient curtain includes a third air conduit disposed outwardly of said second air conduit and a third plurality of fans positioned within said third air conduit for drawing ambient air into said third conduit and propelling such ambient air through said third conduit towards an outlet in said third conduit that directs such ambient air in a direction along a path for forming said ambient air curtain.

13. A system according to claim 10 wherein each of said first plurality of fans is capable of being selectively operated at a first speed during the refrigeration cycle and at a second higher speed during the defrost cycle.

14. A system according to claim 10 wherein only some of the fans of said first plurality of fans are operated during the refrigeration cycle and all of the fans of said first plurality of fans are operated during the defrost cycle so that there is an increased flow of air through said first conduit during the defrost cycle.

15. A system according to claim 6, 7, 10 or 11 wherein during a defrost cycle said means for establishing said ambient air curtain propels a greater quantity of air along said ambient air curtain as compared to the quantity of air propelled along said ambient air curtain during a refrigeration cycle and during the defrost cycle a portion of such ambient air is able to enter said first conduit due to the absence of said secondary air band across the opening in said cabinet.

16. A system according to claim 15 wherein said means for establishing said ambient air curtain includes at least one fan selectively operable at a first speed during the refrigeration cycle and at a second higher speed during the defrost cycle.

17. A system according to claim 15 wherein said means for establishing said ambient air curtain includes a plurality of fans.

18. A system according to claim 17 wherein only some of the fans of said plurality of fans are operated during a refrigeration cycle and all of the fans of said plurality of fans are operated during a defrost cycle so that a greater quantity of air is propelled along said ambient air curtain during a defrost cycle as compared to the quantity of air propelled along said ambient air curtain during a refrigeration cycle.

19. A system according to claim 5 wherein said control means includes means for varying the voltage applied to said first fan for changing the speed of said first fan.

20. A system according to claim 19 wherein said means for establishing said ambient air curtain includes at least one fan selectively operable at a first speed during the refrigeration cycle and at a second higher speed during the defrost cycle.

21. A system according to claim 20 wherein said control means includes means for varying the voltage applied to said ambient air fan for changing the speed of said ambient air fan.

22. An open front refrigeration system capable of being selectively operated in a refrigeration cycle and a defrost cycle, said system comprising:

a cabinet having top, bottom and side walls and an opening in one of said side walls forming the front of said cabinet for enabling access to products displayed within said cabinet;

means for establishing a primary band of refrigerated air within said cabinet, said means including a first air conduit extending around said cabinet and having an air outlet and air inlet at respective opposing ends of said opening in said cabinet; first air circulating means for circulating air through said first air conduit, said first air circulating means being selectively operable in first and second modes of operation, where during said second mode of operation a greater quantity of air is circulated within said first air conduit for a given period of time than during said first mode of operation; refrigeration means for cooling air being circulated through said first air conduit during a refrigeration cycle; and means for directing air leaving said outlet of said first air conduit towards said inlet of said first air conduit;

means for establishing a secondary air band passing along a path outside of said primary air band, said means including: a second air conduit extending around said cabinet and positioned towards the outside of said cabinet with respect to said first air conduit and having an air outlet and an air inlet at respective opposing ends of said opening in said cabinet; second air circulating means for circulating air through said second air conduit for creating said secondary air band, said second air circulating means being selectively switchable between an on and off condition; and means for directing air leaving said air outlet of said second air conduit towards said air inlet of said second air conduit;

control means for controlling the operation of said first and second air circulating means and said refrigerating means, during a refrigeration cycle said control means causing said first air circulating means to be operated in its first mode of operation, said refrigerating means to be operated for cooling the air moving through said first air conduit and said second air circulating means to be in its on condition and during a defrost cycle said control means switching said first air circulating means into its second mode of operation for increasing the quantity of air flowing through said first air conduit and turning off said refrigeration means and said second air circulating means so that ambient air is drawn into said first air conduit and such ambient air acts to defrost any frost buildup in said first air conduit; and means for establishing an ambient air curtain along a path outside of and substantially parallel to the portion of said second air band passing across said opening in said cabinet.

23. A system according to claim 22 wherein said means for establishing said ambient curtain includes a third air conduit mounted along the outside of said cabinet and a third fan positioned within said third air conduit for drawing ambient air into said third conduit and propelling air through said third conduit towards an outlet in said third conduit that directs such ambient air in a direction along a path for forming said ambient air curtain.

24. A system according to claim 22 or 23 wherein said first air circulating means includes a first plurality of fans and said second air circulating means includes a second plurality of fans.

25. A system according to claim 24 wherein each of said first plurality of fans is capable of being selectively operated at a first speed during the refrigeration cycle and at a second higher speed during the defrost cycle.

26. A system according to claim 24 wherein only some of the fans of said first plurality of fans are operated during the refrigeration cycle and all of the fans of said first plurality of fans are operated during the defrost cycle so that there is an increase flow of air through said first conduit during the defrost cycle.

27. A system according to claim 22 wherein during a defrost cycle said means for establishing said ambient air curtain propels a greater quantity of air along said ambient air curtain as compared to the quantity of air propelled along said ambient air curtain during a refrigeration cycle and during the defrost cycle a portion of such ambient air is able to enter said first conduit due to the absence of said secondary air band across the opening in said cabinet.

28. A system according to claim 27 wherein said means for establishing said ambient air curtain includes at least one fan selectively operable at a first speed during the refrigeration cycle and at a second higher speed during the defrost cycle.

29. A system according to claim 27 wherein said means for establishing said ambient air curtain includes a plurality of ambient air fans.

30. A system according to claim 29 wherein only some of the fans of said plurality of ambient air fans are operated during the refrigeration cycle and all of the fans of said plurality of ambient air fans are operated during the defrost cycle so that a greater quantity of air is propelled along said ambient air curtain during a defrost cycle as compared to the quantity of air propelled along said ambient curtain during a refrigeration cycle.

31. A system according to claim 29 or 30 wherein said top wall of said cabinet has a plurality of openings and said means for establishing said ambient air curtain includes a third air conduit extending from said top wall of said cabinet to the top portion of said opening in said front wall of said cabinet and said third air conduit has openings therein in communication with said openings in said top wall of said cabinet for enabling ambient air to enter said third air conduit.

32. A system according to claim 31 wherein said ambient air fans are arranged with said third air conduit for drawing ambient air into said third air conduit.

33. A system according to claim 24 wherein said first plurality of fans are arranged within said first air conduit along a portion thereof adjacent to said top wall of said cabinet.

34. A system according to claim 24 wherein said second plurality of fans are arranged within said second air conduit along a portion thereof adjacent to said top wall of said cabinet.

* * * * *

UNITED STATES PATENT AND TRADEMARK OFFICE

CERTIFICATE OF CORRECTION

PATENT NO. : 4,302,946

DATED : December 1, 1981

INVENTOR(S) : Fayez F. Ibrahim

It is certified that error appears in the above—identified patent and that said Letters Patent is hereby corrected as shown below:

Column 5, line 13: "cooler" should read --colder--.

Column 10, line 14: "5" should read --15--.

Column 4, line 43: "side-walls" should read --side walls--.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*